United States Patent [19]

Lense

[11] 4,307,542

[45] Dec. 29, 1981

[54] WINDOW

[75] Inventor: Robert F. Lense, Rockford, Ill.

[73] Assignee: Amerock Corporation, Rockford, Ill.

[21] Appl. No.: 82,476

[22] Filed: Oct. 9, 1979

[51] Int. Cl.[3] ..... E06B 7/28

[52] U.S. Cl. ..... 49/318; 49/320; 49/390

[58] Field of Search ..... 49/317, 318, 320, 390; 16/169

[56] References Cited

U.S. PATENT DOCUMENTS

| | | | |
|---|---|---|---|
| 801,506 | 10/1905 | Blanchard | 49/317 |
| 2,268,114 | 12/1941 | Foster et al. | 49/318 |
| 2,731,681 | 1/1956 | Gall | 49/317 X |
| 2,753,020 | 7/1956 | Ware, Jr. | 49/318 |
| 2,805,451 | 9/1957 | Evans et al. | 49/318 |
| 2,805,741 | 9/1957 | Evans et al. | 49/318 |
| 3,335,523 | 8/1967 | Isler et al. | 49/317 X |
| 3,368,236 | 2/1968 | Kirby | 16/169 X |
| 3,374,821 | 3/1968 | White | 49/320 X |
| 4,080,758 | 3/1978 | Hubbard | 49/390 |
| 4,081,934 | 4/1978 | Franz | 49/390 X |

FOREIGN PATENT DOCUMENTS

| | | | |
|---|---|---|---|
| 1509543 | 6/1969 | Fed. Rep. of Germany | 49/317 |

*Primary Examiner*—Philip C. Kannan

*Attorney, Agent, or Firm*—Leydig, Voit, Osann, Mayer & Holt, Ltd.

[57] ABSTRACT

A window with a sash mounted in a frame has elongated draft stops extending along the rails of the sash. The draft stops are disposed in the frame and normally project out to overlap the sash rails. The draft stops are retractible outwardly beyond the outer edges of the rails and the sash is mounted to turn about its vertical centerline when the draft stops are retracted. When a handle mounted in the frame is turned in one direction, it operates a mechanism to retract the lower draft stop. The side draft stops retract in response to retraction of the lower draft stop and this, in turn, raises the upper draft stop so that all of the draft stops are retracted together. Turning the handle in the opposite direction returns all of the draft stops to their projected or active position.

1 Claim, 17 Drawing Figures

WINDOW

BACKGROUND OF THE INVENTION

This invention relates to windows having a sash mounted within a frame and, more particularly, to comparatively large windows such as those commonly called a picture window. Normally, the sash in such a window is held in the frame in a fixed position by elongated draft stops which project inwardly from the frame and overlap the rails and stiles of the sash. Usually, draft stops are employed on both the inside and outside of the sash.

It would be desirable to be able, under certain conditions, to move the sash. For example, the sash could be opened for purposes of ventilation at times and thus reduce the need for air conditioning. Also, it is desirable for two reasons that the sash may be turned completely around so that each side of the pane of the sash may be either inside or outside. First, this makes it easy to clean both sides of the sash from the inside. Second, one side of the pane may be reflective in which case that side can face out in the summer and in during the winter.

SUMMARY OF THE INVENTION

The general object of the invention is to provide a new and improved picture window in which the sash is capable of turning about a centerline, preferably the vertical centerline of the sash, but is normally held in a fixed position by the draft stops and in which all the draft stops may be retracted together upon the actuation of an easily operated manual means so that the sash may swing about the centerline.

Another object is to use a handle as a manual means, arrange the handle to retract one draft stop through a mechanism which provides a mechanical advantage and to retract the remaining draft stops in response to the retraction of the one draft stop so that all of the draft stops are easily retracted together even though the window is relatively large.

A further object is to construct the draft stops along at least some sides of the sash so that an inside draft stop and the associated outside draft stop are flanges of an elongated channel member whereby the channel member effectively seals around the corresponding side of the sash even though the member is movable back and forth between its active or sealing position and a retracted position.

The invention also resides in the particular construction of the mechanism connecting the handle with the one draft stop, in the means for interconnecting the other draft stops to the one draft stop so that all the draft stops move together, in the means for selectively holding the sash in a ventilating position or permitting the sash to swing through 360 degrees, and in the means for mounting the sash so that it may be completely removed from the window frame.

DETAILED DESCRIPTION OF THE PREFERRED EMBODIMENTS

Figure 5:
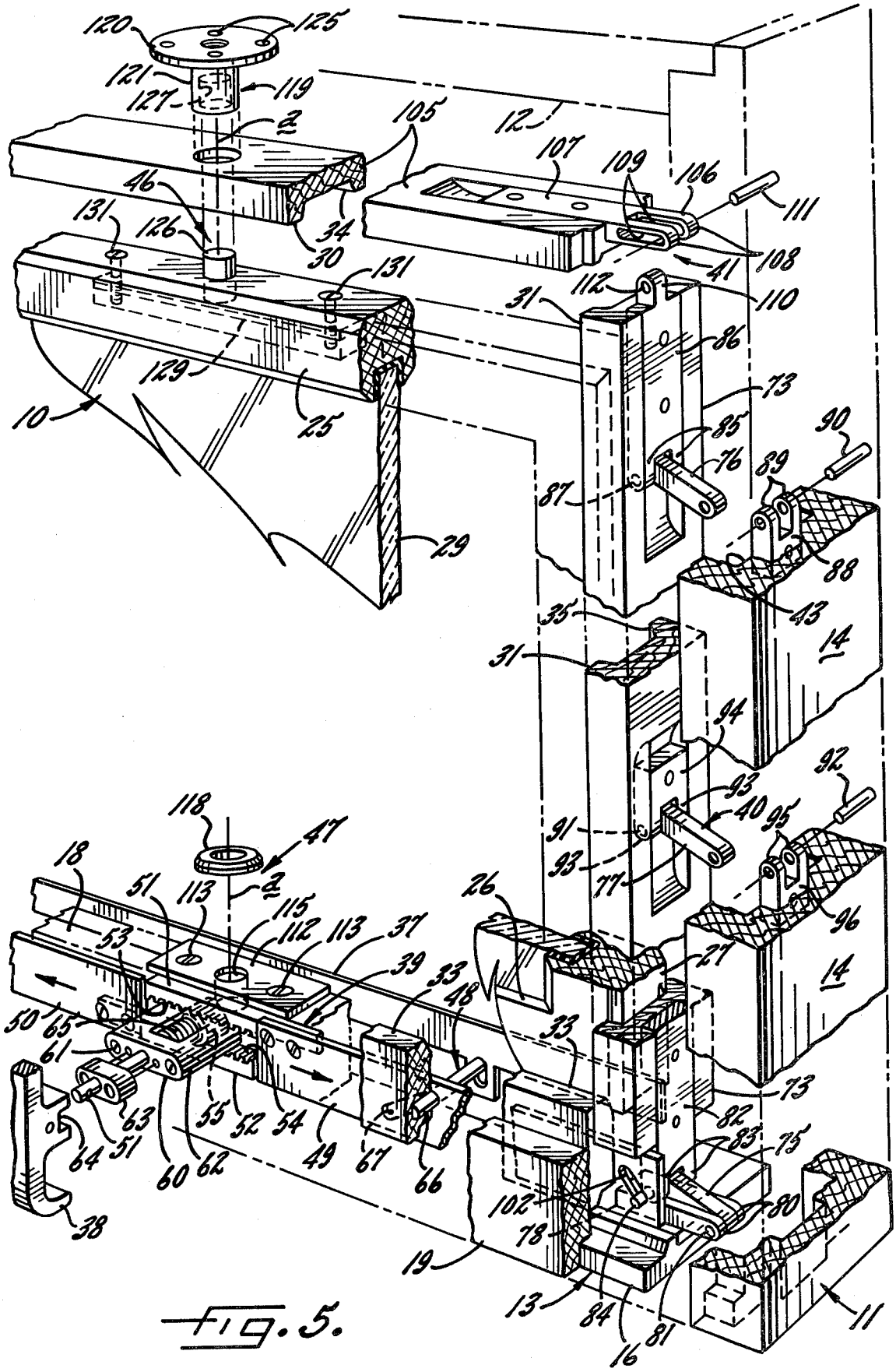
FIG. 5 is an enlarged fragmentary perspective view of the principal components for moving the draft stops.
Figure 6:
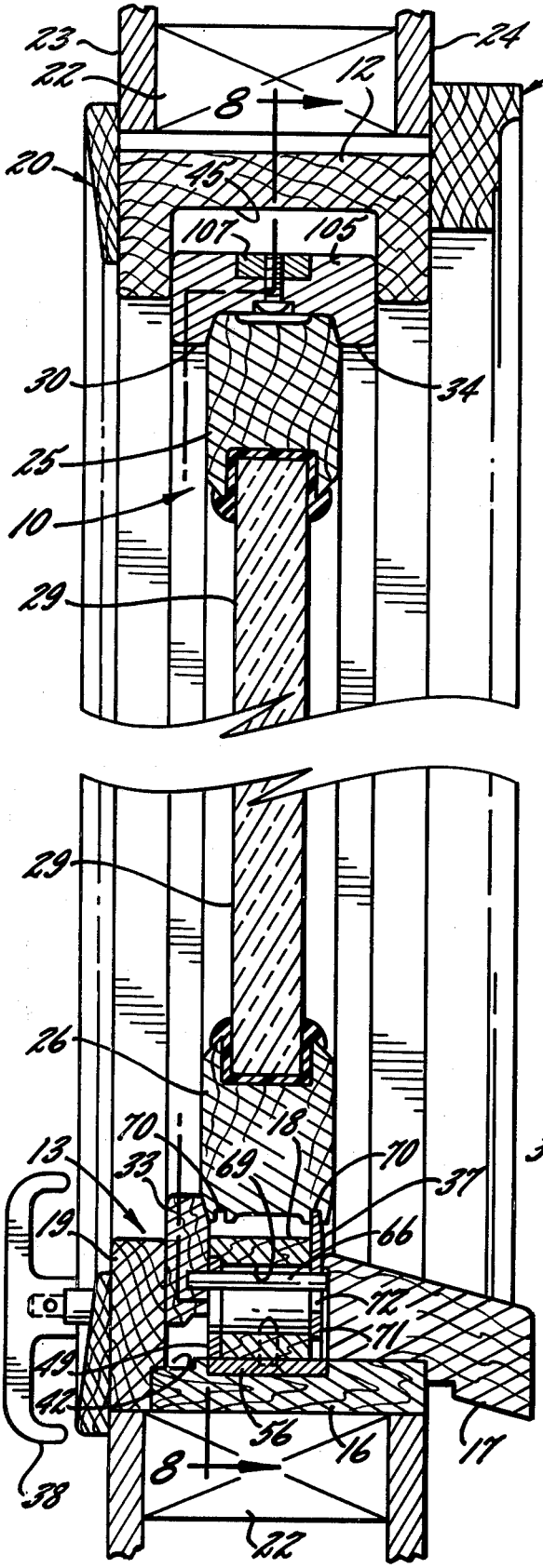
FIG. 6 is an enlarged sectional view taken along the line 6—6 in FIG. 1.

As shown in the drawings for purposes of illustration, the invention is embodied in a window having a rectangular sash 10 mounted in a rectangular frame 11 and the invention is particularly useful for a window of the type in which the sash normally is in a fixed, closed position in the frame such as the conventional picture window. The frame includes a horizontal head jamb 12 at the top (see FIGS. 1, 5 and 8), a horizontal sill 13 at the bottom and vertical side jambs 14 and 15 at opposite sides of the frame and connecting the head jamb and the sill to form a rigid frame. Herein, as illustrated in FIG. 6, the sill 13 includes a rough sill 16, a finish sill 17 and an elongated horizontal mounting bar 18 on top of the rough sill all of which are suitably secured together. The sill also includes an apron 19 fastened to the rough sill 16. The frame 11 is mounted in the wall of a building in the normal manner with a decorative rectangular molding 20 attached to the frame on the inside of the window and a generally similar decorative molding 21 attached to the frame on the outside. The frame is mounted in the conventional manner in an opening in a wall between construction members 22 (FIG. 6) with the inner molding 20 overlapping the plaster 23 or other finish on the inside and the outer molding 21 overlapping siding 24 or the like.

The sash 10 is disposed within the rectangular opening defined by the frame 11 and comprises horizontal top and bottom rail 25 and 26 joined by vertical stiles 27 and 28, one at each side of the sash. A rectangular pane 29 of glass or similar transparent material is held in the usual manner between the rails 25 and 26 and the stiles 27 and 28 to complete the sash. To prevent warm or cold air from seeping between the frame 11 and the sash 10, an elongated sash stop 30 projects out from the frame and overlaps the top rail 25 of the sash on the inside thereof and similar sash stops 31, 32 and 33 overlap the stiles 27 and 28 and the bottom rail 26 respectively. On the outside of the window, similar sash stops 34, 35 and 36 (FIGS. 2, 4, 5 and 9) overlap the top rail 25 and the stiles 26 and 27. As will be explained later more in detail, an elongated sash stop 37, which is more in the nature of a weather seal, overlaps the bottom rail 26 of the sash on the outside thereof.

Although the sash 10 in windows of this type normally are in a fixed position relative to the frame 11, maintenance and conservation of energy make it desirable that, upon occasion, the sash be capable of being moved such as being swung about the vertical centerline a of the sash. For example, the use of heating and air conditioning may be reduced if the sash may be tilted out in one direction or the other (see FIGS. 2 and 3) to permit the entry of either warm air or cool air, depending upon the temperatures of the air inside and outside of the window. In addition, it may be desirable to swing the sash through 180 degrees. For example, the pane 29 may have a reflective side in which case that side is more effective if it is on the outside during the summer months and on the inside during the winter months. In addition, swinging of the sash through the 180 degree angle permits both sides of the pane 29 to be washed from the inside and, similarly, both sides of the rails 25 and 26 and of the stiles 27 and 28 may be cleaned or painted from the inside. For purposes of shipping, installation and replacing the pane 29, it also is advantageous to be able to remove and reinstall the sash while the frame is fixed in place.

Accordingly, the present invention contemplates the provision of a novel window in which the sash 10 normally is in a fixed position relative to the frame 11 but in which, upon the actuation of an easily operated manual means, the sash may be selectively swung out in either direction about a centerline such as the vertical centerline a or may be swung completely through a 180 degree angle to reverse the sides of the sash. To this end, the manual means is operable to retract all of the draft stops to free the sash for swinging and, similarly, this means also is operable to return the stops simultaneously to their normal or active positions when the sash has been swung to a position in which it is in the plane of the frame.

Figure 8:
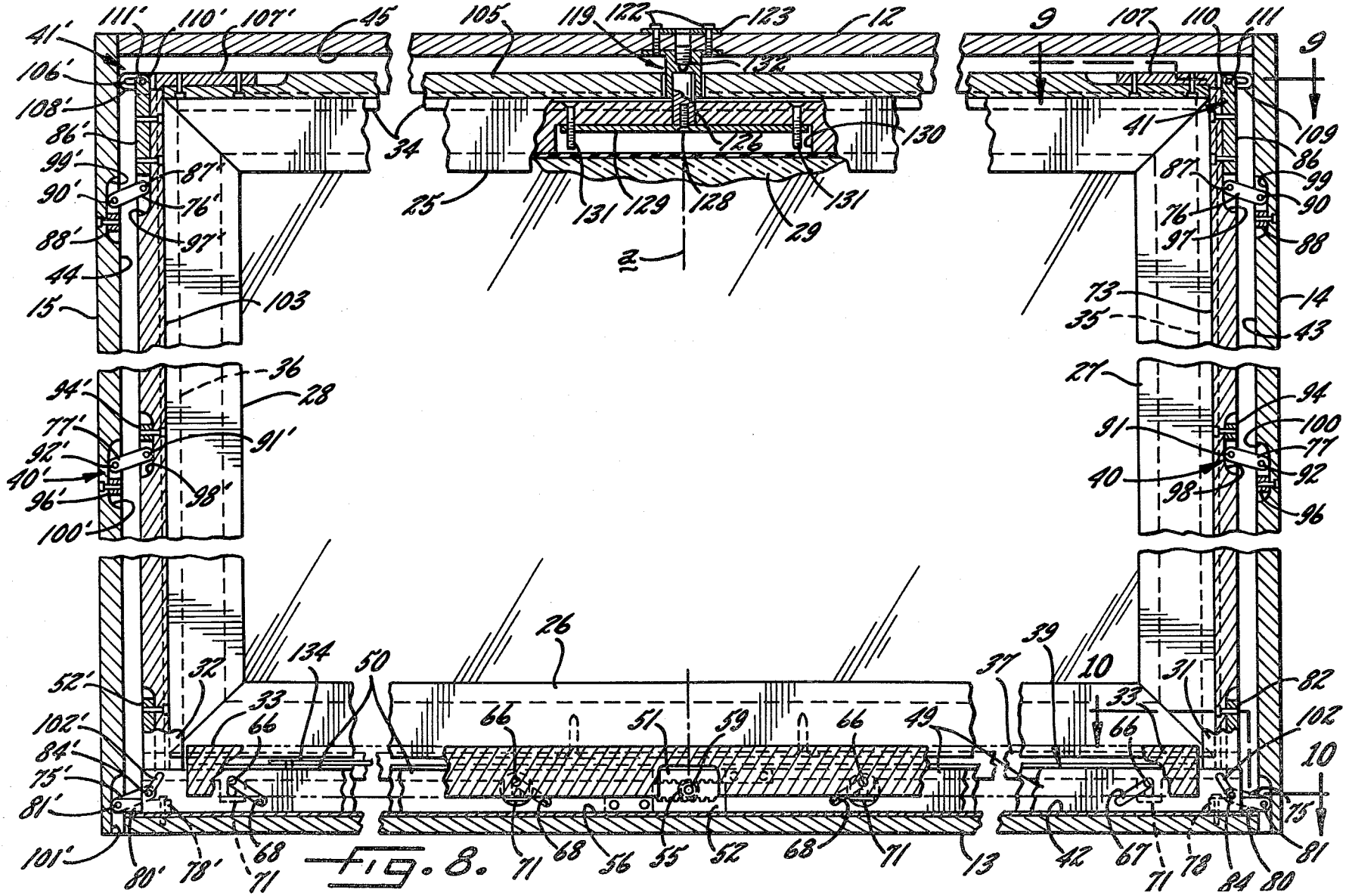
FIG. 8 is a sectional view on a reduced scale taken along the line 8—8 in FIG. 6.
Figure 9:
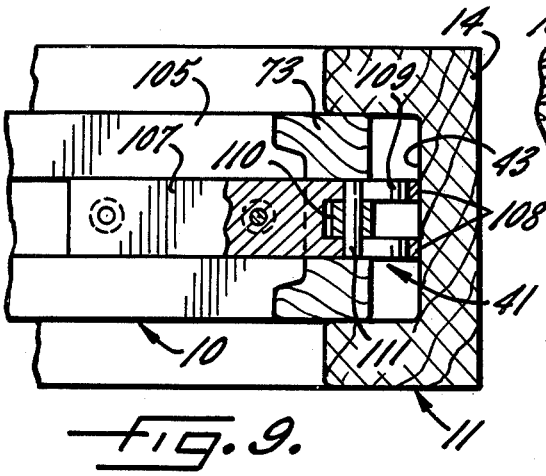
FIG. 9 is an enlarged view taken along the line 9—9 in FIG. 8.
Figure 10:
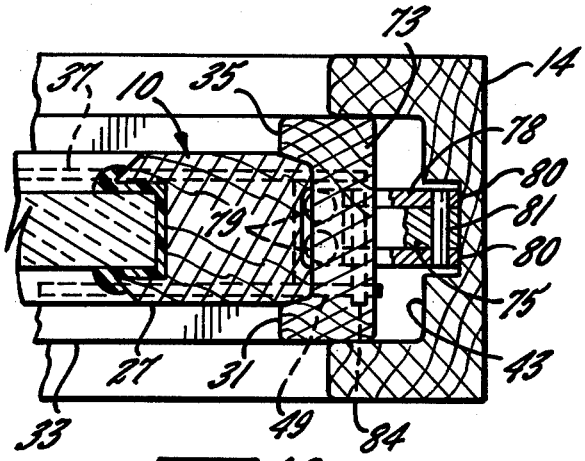
FIG. 10 is an enlarged sectional view taken along the line 10—10 in FIG. 8.

In general, the manually operable means includes a handle 38 mounted on the frame 11, preferably in the sill 13, which is manually movable between a first position (FIG. 1) and a second position (FIG. 2) to move the draft stops from their active positions to their retracted positions. The handle 38 is connected with a mechanical advantage to a first mechanism 39 (FIG. 5) which retracts the draft stops 33 and 37 when the handle is moved to its second position and which returns these stops to their projected positions when the handle is moved back to its first position. A pair of second mechanisms 40 and 40', one of which is shown in FIG. 5, are responsive to the retracting movement of the draft stops 33 and 37 and move the side draft stops 31, 32, 35 and 36 outwardly and upwardly to their retracted positions. A third mechanism 41 (FIGS. 5 and 8) is responsive to the movement of the side draft stops to move the upper draft stops 30 and 34 to their retracted positions. The second and third mechanisms 40 and 41 also are operable to return the side and upper draft stops to their projected positions as the first mechanism 39 returns the lower draft stops to their projected positions. As shown in FIGS. 6, 8 and 9, the draft stops and their associated mechanisms are disposed in elongated recesses 42, 43, 44 and 45 formed respectively in the sill 13, the side jambs 14 and 15 and the head jamb 12. To permit the sash 10 to turn about the centerline a when the draft stops are retracted, the top rail 25 of the sash connected to the head jamb by a pivot assembly 46 (FIG. 5) and the bottom rail 26 is connected to the sill 13 by a second pivot assembly 47 (FIGS. 5 and 7).

Figure 12:
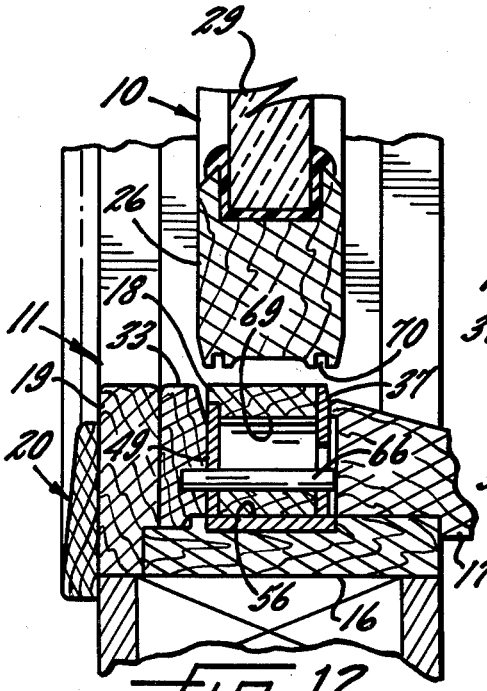
FIG. 12 is a fragmentary sectional view taken along the line 12—12 in FIG. 11.

The first mechanism 39 which operates the lower draft stops 33 and 37 extends along the recess 42 and preferably elongates when the handle 38 is moved to its second position and contracts when the handle is moved to its first positions, elongation being effective to lower the stops to the position shown in FIG. 12 and contraction raises the stops to their active or projected positions. To achieve this cams 48 (FIGS. 5 and 8) transmit the expanding and contracting motion to the draft stops 33 and 37 to move the latter down and up. Preferably, the mechanism 39 comprises two flat bars 49 and 50 disposed end to end and lying alongside the inner side of the recess 42. Rigid with the inner end of the bar 49 and projecting inwardly from the upper portion thereof is a rack 51 formed on its underside with teeth. A similar rack 52 projects inwardly from the lower portion of the bar 50 with the teeth 53 and 54 of the racks spaced apart and opposing each other. Between the racks and meshing with both the teeth 53 and the teeth 54 is a pinion 55 which turns about a horizontal axis so that, when the pinion is turned clockwise as viewed in FIGS. 5 and 8, the bars 49 and 50 slide apart endwise and the bars slide together when the pinion is turned counterclockwise, the pinions and the racks providing a mechanical advantage between the handle and the bars. To provide a wear-resistant surface on which the bars slide, a horizontal plate 56 (FIGS. 5, 6 and 7) is clamped between the rough sill 16 and the mounting member 18 so that the lower edges of the bars slide on the plate.

Figure 7:
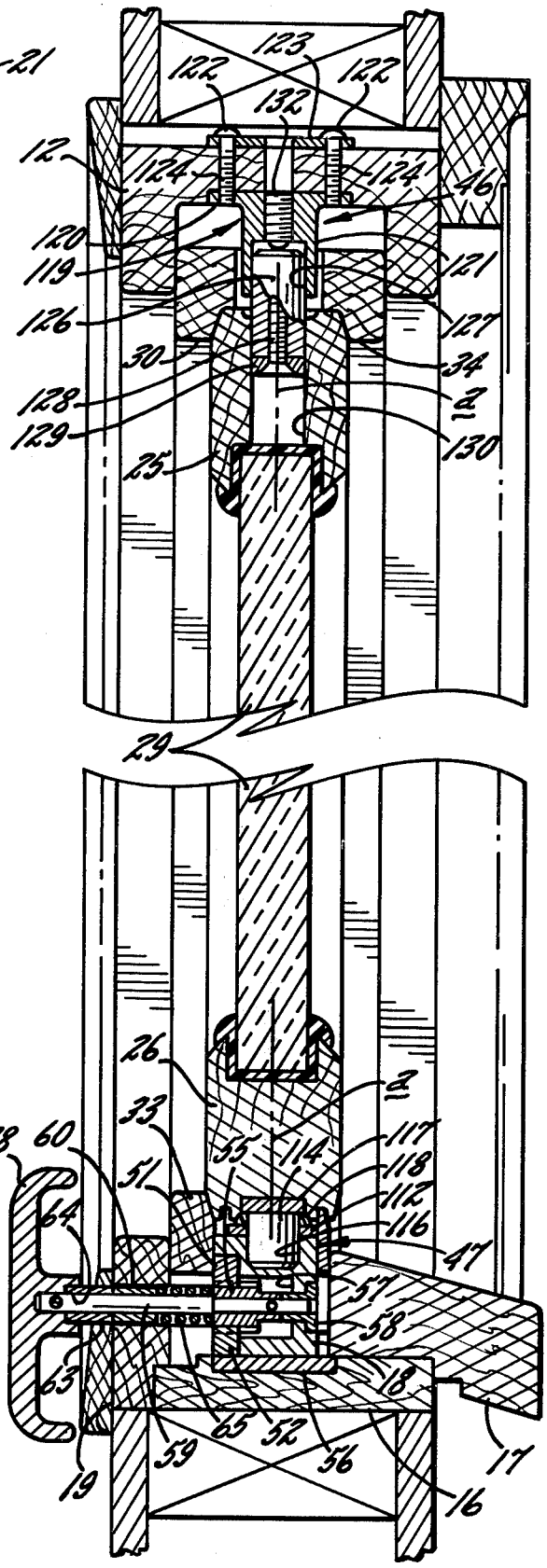
FIG. 7 is an enlarged sectional view taken along the line 7—7 in FIG. 1.

As indicated at 57 in FIG. 7, the mounting member 18 of the sill 13 is routed out to receive the pinion 55 and to permit movement of the racks 51 and 52. Secured to the back of the mounting member is a bearing 58 which receives a shaft 59 pinned to the pinion 55 and extending along the axis thereof. The shaft also projects through a bearing member 60 (FIGS. 5 and 7) which is disposed in the routed opening 57 in front of the pinion and is fastened to the mounting member 18 by screws 61 projecting through legs 62 on the bearing member. The bearing 58 and the bearing member 60 support the shaft and the pinion for limited axial movement, the axial length of the pinion being sufficient that the pinion remains in mesh with the racks 51 and 52, and they also support the shaft for turning so that the pinion slides the bars 49 and 50 back and forth but in opposite directions due to the rack 51 engaging the top of the pinion and the rack 52 engaging the bottom of the pinion.

Figure 1:
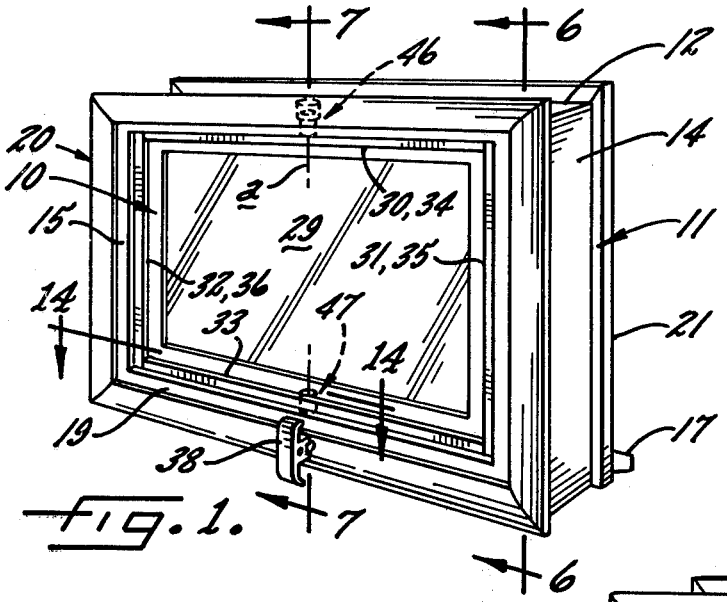
FIG. 1 is a perspective view of a window embodying my invention.

The shaft 59 projects through the inside molding 20 and the handle 38 is pinned to the outer end of the shaft to turn the shaft and hence the pinion 55 (See FIGS. 1, 6 and 7). Herein, the handle is elongated and, when the handle is in its first position, it is vertical and the bars 49 and 50 are contracted while the bars are expanded when the handle is turned to its second or horizontal position. To prevent the handle from being turned accidentally from its vertical position, a key 63 (FIGS. 5 and 6) is secured to the outside of the bearing member 60 and is received in a recess 64 in the inner side of the handle. A compression spring 65 (FIGS. 5 and 7) encircles the shaft 59 and acts between the pinion 55 and the bearing member 60 to urge the handle into engagement with the key. When it is desired to turn the pinion and retract the draft stops, the handle first is pulled out of engagement with the key against the action of the spring 65 and then is turned to the vertical position (see the broken line position in FIG. 7).

In the present instance, the lower draft stop 33 on the inside of the window is made of wood and slides vertically in the recess 42 between the apron 19 and the mounting member 18 (see FIG. 6). In its upper position, this stop abuts the lower rail 26 of the sash 10 and, when retracted (FIG. 12), the stop is below the lower edge of the sash. The cams 48 for moving the draft stop 33 down and up as the bars 49 and 50 expand and contract are of the pin and slot type. Thus, four pins 66 (FIGS. 5, 6 and 8) are rigidly fixed to and extend horizontally inwardly from the stop 33 at spaced points along the latter. Two of the pins project through slots 67 which are formed in the bar 49 and are inclined upwardly and to the right as viewed in FIG. 8. The other two pins project through slots 68 formed in the bar 50 and inclined upwardly and to the left. With this arrangement, the slots, as the bars are moved apart, cam the pins and hence the stop 33 down while the slots cam the pins and the stop back up as the bars are moved together. Suitable holes 69 (FIG. 6) are routed in the mounting bar 18 to accommodate this movement of the pins 66.

Figure 13:
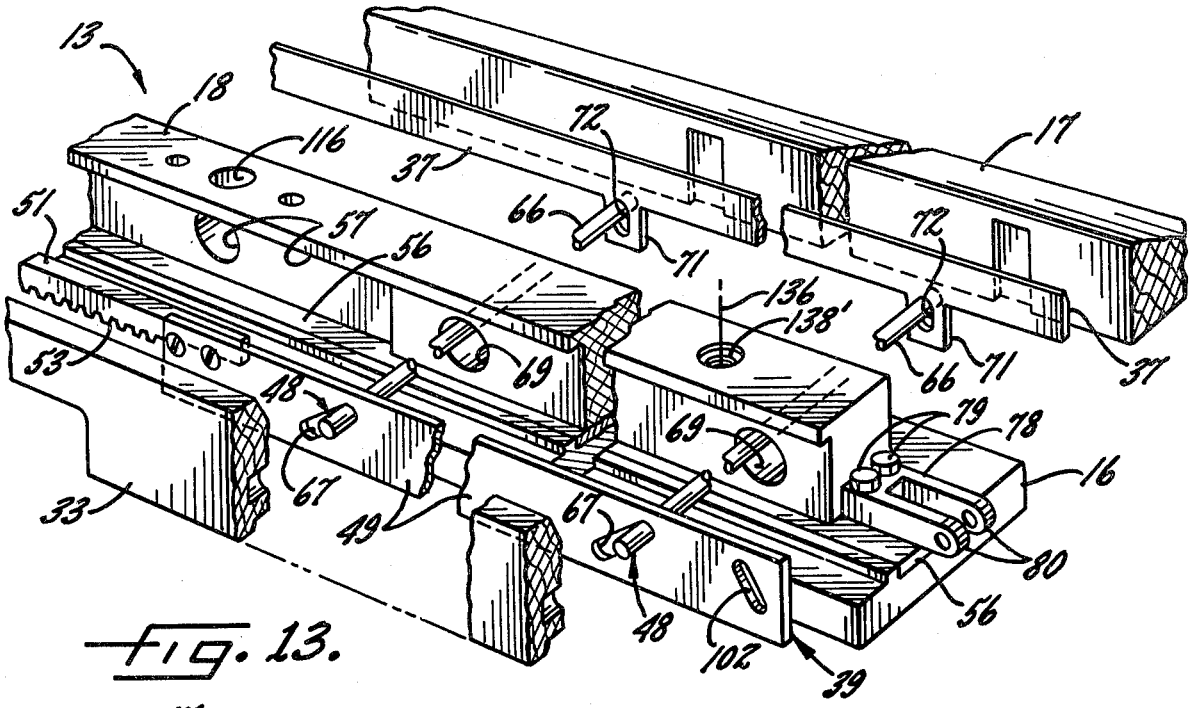
FIG. 13 is a fragmentary, exploded perspective view of the mechanism for moving the lower draft stops.

As stated earlier, the lower draft stop 37 on the outside of the window is more in the nature of a weather seal and for this purpose, this stop is an elongated metal or plastic bar extending horizontally throughout the length of the lower rail 26 of the sash 10 (see FIGS. 5 and 6). The bar 37 is disposed in the recess 42 between the mounting bar 18 and the finish sill 17 and, in its upper or active position, the upper edge of the bar is received in one of two grooves 70 (FIGS. 6 and 12) in the underside of the sash rail 26, depending on sash position. The weather seal bar 37 is moved up and down with the draft stop 33 by the pins 66 but, because in the present embodiment the bar moves only half the distance of the draft stop, there is a lost motion connection between the pins and the bar. Thus, four ears 71 (FIGS. 5, 8 and 13) depend from the bar 37 and are formed with vertical slots 72 which receive the inner ends of the pins 66. The length of the slots 72 is one-half the length of the vertical travel of the draft stop 33 and the pins 66 engage the upper ends of the slots when the draft stop 33 is in its upper position as shown in FIG. 6. As the bars 49 and 50 move the draft stop 33 down, the pins move down in the slots 72 and then engage the bottoms of the slots. Thereafter, the pins slide the weather seal bar 37 down to its retracted position as shown in FIG. 12.

As shown most clearly in FIGS. 5, 8, 10 and 11, the second mechanism 40 which moves the draft stops 31 and 35 to their retracted position and back to their projected or active position is responsive to the endwise movement of the bar 49. The present invention contemplates making at least some of the inner draft stops and their corresponding outer draft stops as a channel member to provide a good seal around the sash and, accordingly, the stops 31 and 35 herein are made of wood and are integral flanges on the inner side of an elongated vertical block 73 and, in moving to the retracted position, the block swings both outwardly and upwardly in a recess 43 formed in the side jamb 14. To support the block for such swinging, the block is mounted on the side jamb 14 of the window frame 11 by a master link 75 at the bottom of the block and by two auxiliary links 76 and 77, the link 76 being adjacent the top of the block and the link 77 being at or near the center of the block. The three links are on the back side of the block and are parallel to each other to form a parallelogram linkage.

The master link 75 is mounted on the side jamb 14 through the medium of the rough sill 16 and, for this purpose, a bracket 78 (FIGS. 5 and 13) is secured on top of the end portion of the rough sill as by a fastener 79 and includes spaced horizontal arms 80 which project outwardly. The outer end of the link 75 is disposed between and pivoted to the outer ends of the arms 80 by a pin 81. A metal plate 82 is recessed in the back of the block 73 and is fastened to the latter and the plate includes downwardly projecting legs 83 which straddle the inner end of the link 75 and are pivotally connected to the latter by a pin 84. The inner end of the upper link 76 is disposed between the downwardly projecting legs 85 of a second metal plate 86, which is recessed in and fastened to the back of the block 73 adjacent the upper end thereof, and the link 76 and legs 85 are pivotally connected by a pin 87. Generally opposite and slightly below the plate 86 is a metal bracket 88 which is recessed in and fastened to the inner side of the side jamb 14. The outer end of the link 76 projects between spaced ears 89, upstanding on the bracket 88 and the link is pivotally connected to the ears 89 by a pin 90. Similarly, the link 77 is pivotally connected by pins 91 and 92 to the legs 93 of a metal plate 94 and to the ears 95 of a metal bracket 96.

Figure 11:
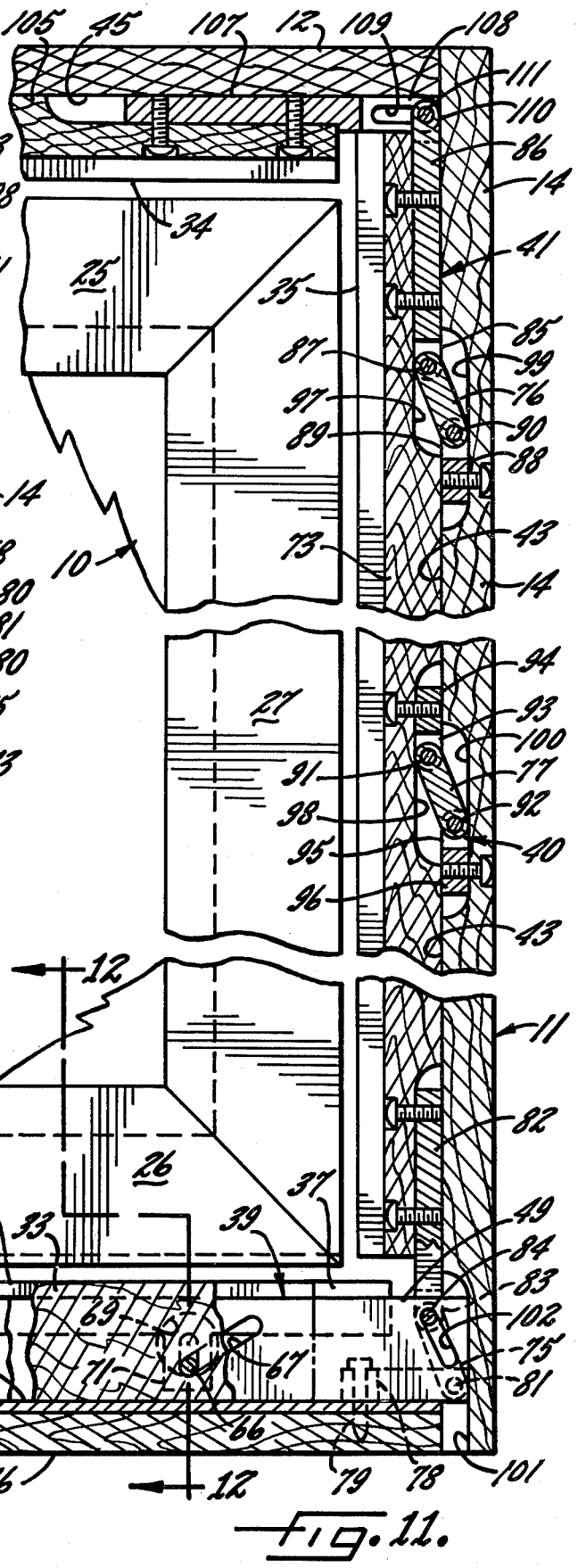
FIG. 11 is an enlarged fragmentary sectional view similar to the right-hand portion of FIG. 8 but showing the parts in a moved position.

With the foregoing arrangement, the links 75, 76 and 77 support the block 73 and hence the draft stops 31 and 35 to swing outwardly and upwardly from the active or projected position shown in FIG. 8 to the retracted position illustrated in FIG. 11 and back to the active position. The back of the block 73 is recessed at 97 and 98 and the inner side of the jamb 14 is recessed at 99, 100 and 101 to accommodate the swinging of the links. To achieve this swinging in response to the endwise movement of the bar 49, the pin 84 of the master link 75 is elongated and projects into a downwardly and outwardly extending slot 102 (FIGS. 5 and 13) formed in the bar. Thus, the slot 102 and the pin 84 constitute a cam and follower. As the bar 49 slides outwardly, the slot lifts the pin 84 and causes the master link 75 to swing upwardly. The links 76 and 77 swing in unison with the master link and the three links thereby carry the block 73 to the inactive position. Upon inward movement of the bar 49, the slot 102 moves the pin 84 down thereby swinging master link 75 and the links 76 and 77 downwardly and returning the block 73 to its projected position.

Like the draft stops 31 and 35, the draft stops 32 and 36 on the other side of the window are integral flanges on an elongated vertical wooden block 103 and, in response to the outward and inward sliding of the bar 50, the block 103 swings upwardly and outwardly to its retracted position and downwardly and inwardly to its projected position, the block swinging in a recess 44 formed in the side jamb 15. The mechanism 40' which swings the block 103 in response to the sliding of the bar 50 is the same as the mechanism 40 for swinging the block 73 and corresponding parts are identified by the same but primed reference characters (see FIG. 8.)

As in the case of the side draft stops, the upper draft stops 30 and 34 are integral flanges on an elongated wooden block 105 (FIG. 5), except that in this case the block extends horizontally and the stops project downwardly, and the block 105 moves up and down in a recess 45 (FIG. 6) in the head jamb 12. The third mechanism 41 which is responsive to the movement of the side draft stops and which moves the upper draft stops herein responds to the vertical motion of the blocks 73 and 103 and basically two pin and slot connections 106 and 106', one at each end of the block 105 (see FIGS. 5, 8, 9 and 11). Thus, the connection at the right side of the window as viewed in FIG. 8 includes a metal plate 107 recessed in and fastened to the upper side of the block 105 adjacent the end thereof (see FIG. 5). Spaced parallel legs 108 project horizontally from the outer end of the plate 107 and extend beyond the end of the block 105 and elongated horizontal slots 109 are formed in the legs. A lug 110 projects up from the plate 86 above the upper end of the block 73 and is received between the legs 108 and a pin 111 pressed into a hole 112 in the lug 110 has its ends project into the slots 109 with a sliding fit. The pin and slot connection at the other end of the block 105 is the same and corresponding parts are identified by the same but primed reference characters. With this arrangement, the pins 111 and 111' raise and lower the block 105 upon the upward and downward movement of the side blocks 73 and 103 while the slots 109 and 109' accommodate the outward and inward movement of the side blocks. As a result, all of the draft stops are moved back and forth simply by turning the handle 38.

As seen in FIGS. 5 through 10, the outer edges of the sash rails and stiles 25, 26, 27 and 28 and the abutting surfaces of the draft stops 30, 31, 32, 33, 34, 35 and 36 have complementary bevels so as to provide good seals. Because water, snow and ice may accumulate on the finish sill 17, the draft stop 37 interlocks in one of the grooves 70 in the bottom rail 26 to provide a more complete weather seal. When the draft stops are retracted as shown in FIG. 11, however, all of the draft stops are clear of the sash 10 which then is free to turn about the centerline a.

To permit the sash 10 to turn about centerline a, the sash is mounted between the head jamb 12 and the mounting bar 18 by the upper and lower pivot assemblies or trunnions 46 and 47 (FIGS. 5, 7 and 8). The lower trunnion 47 includes a flat metal plate 112 lying along the upper side of the mounting bar 18 and fastened to the latter by screws 113. A vertical stub shaft 114 (FIG. 7) whose axis lies on the centerline a projects through a hole 115 in the plate and into a recess 116 in the mounting bar. A head 117 on the upper end of the stub shaft is recessed in and fastened to the underside of the lower sash rail 26 and a plastic washer 118 encircling the shaft is disposed between the plate 117 and the plate 112 so that the shaft may turn in the hole 115.

The upper trunnion 46 includes a bearing 119 with a circular head 120 recessed in the underside of the head jamb 12 and having a downwardly projecting boss 121. The bearing is fastened to the head jamb by screws 122 (FIG. 7) which project through the washer 123 on top of the head jamb and through holes 124 in the latter and are threaded into holes 125 (FIG. 5) in the head 120. A second stub shaft 126, whose axis also lies along the centerline a, projects up into and turns in a downwardly opening bore 127 in the boss 121. The shaft 126 is secured by a screw 128 (FIG. 8) to an elongated plate 129 which is disposed in a slot 130 in the upper sash rail 25. Screws 131 project loosely through the top rail and are threaded into the plate 129. Because the plate cannot turn in the slot 130, tightening the screws 131 clamps the plate against the upper rail and thereby holds the shaft 126 in a position in which it projects above the top rail and into the bore 127. A pointed set screw 132 is threaded down in the center of the bearing 119 and abuts the top of the shaft 126 to take up any play in the trunnions 46 and 47. The depth of the slot 130 is such that, by loosening the screws 131, the plate 129 is lowered to a point near the opening of the slot and, in this position of the plate, the stub shaft 126 is retracted out of the bore 127 and below the upper side of the sash rail. With the shaft retracted and with all of the draft stops retracted, the play in the lower trunnion 47 permits the sash 10 to be tilted inwardly and lifted out of the frame 11 for painting, repair and similar operations on the sash as may be required (see FIG. 4).

Figure 2:
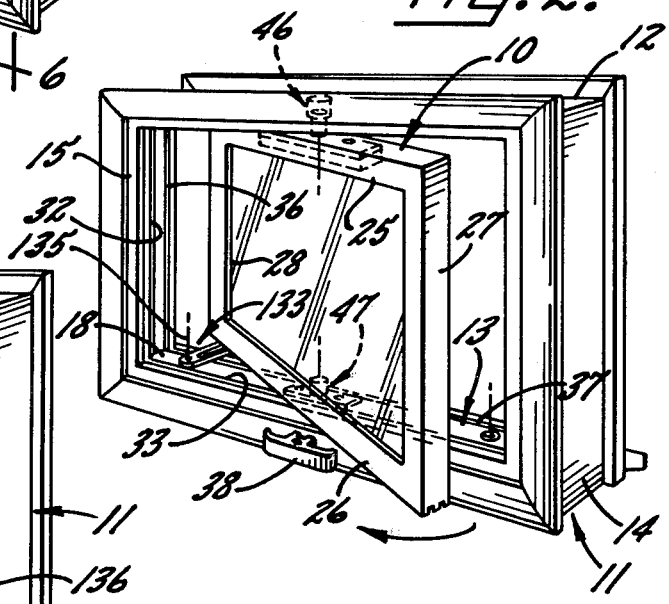
FIG. 2 is a perspective view similar to FIG. 1 with the sash in a moved position.
Figure 3:
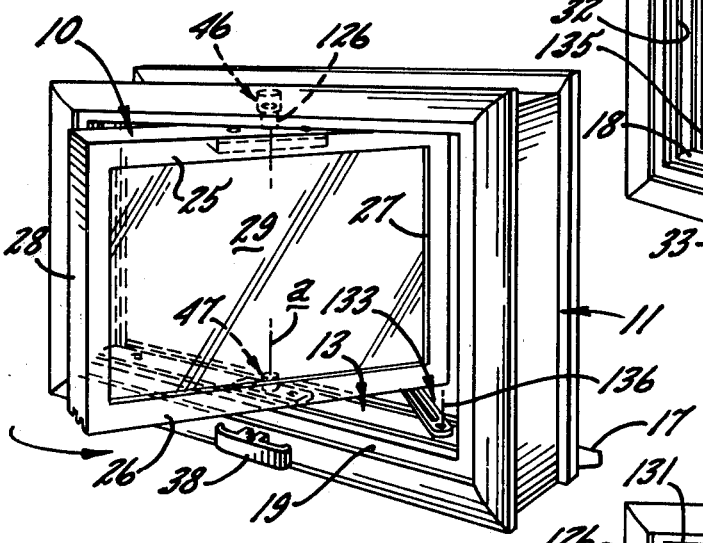
FIG. 3 is a perspective view similar to FIG. 1 with the sash in another moved position.
Figure 4:
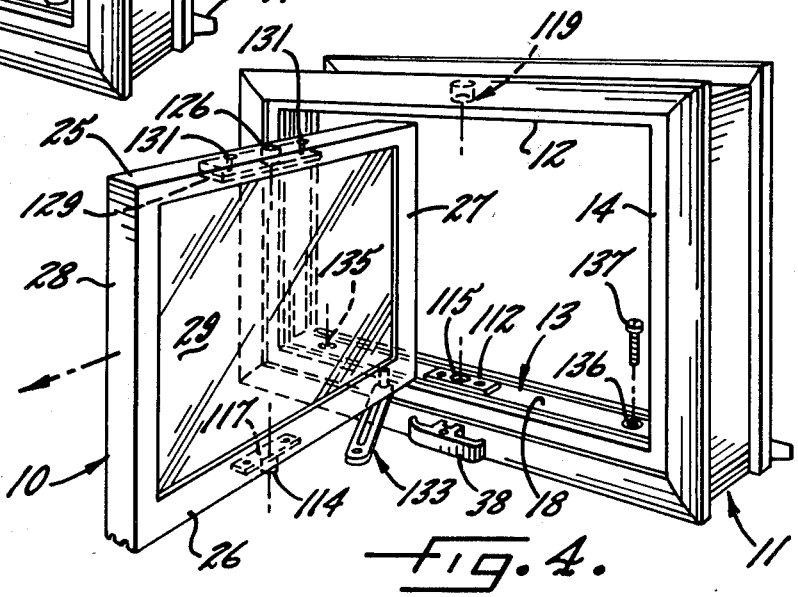
FIG. 4 is a perspective view similar to FIG. 1 with the sash being removed.

As stated earlier, the sash 10 is free to swing on the trunnions 46 and 47 about the centerline a when all the draft stops are retracted. The present invention contemplates that the sash not only be capable of swinging around but also be swung through an acute angle, such as 30 degrees, in either direction and held at that angle for purposes of ventilation. Moreover, when one side of the sash pane 29 is reflective, the sash 10 may, regardless of whether the reflective side of the pane 29 is inside or outside, be swung to the ventilating position in either direction. In general, the left-hand side 28 of the sash may be swung out with one side of the pane 29 on the outside as illustrated in FIG. 2 or the sash may be swung and held with the left side in and the right side 27 out. If the sides of the pane 29 are reversed, a simple adjustment permits the left side 28 of the sash to be swung in to the ventilating angle as shown in FIG. 3 and, with the same side of the pane outside, the ventilating angle may be reversed. To achieve the foregoing, the invention includes a novel latching mechanism 133 which selectively holds the sash in either ventilating position regardless of which side of the pane is facing outwardly and which also permits the sash to be swung through 360 degrees.

Figure 14:
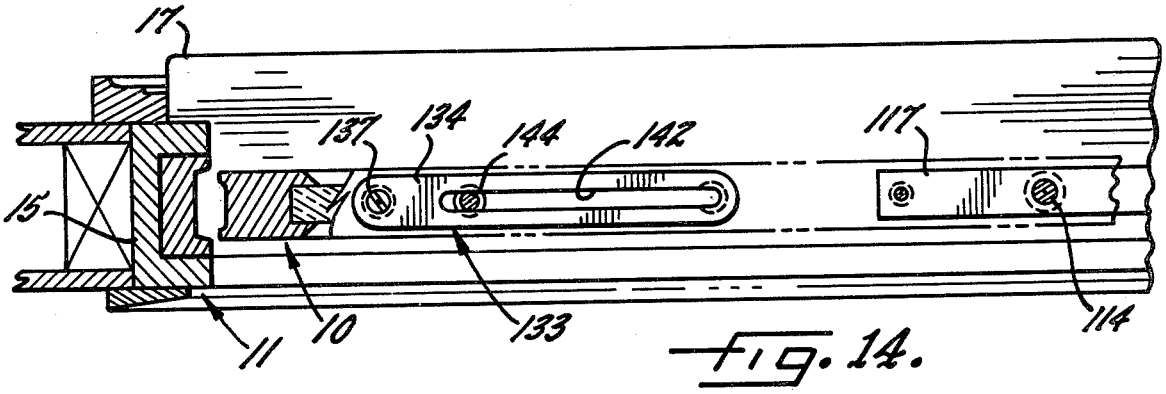
FIG. 14 is an enlarged fragmentary sectional view taken along the line 14—14 in FIG. 1.
Figure 15:
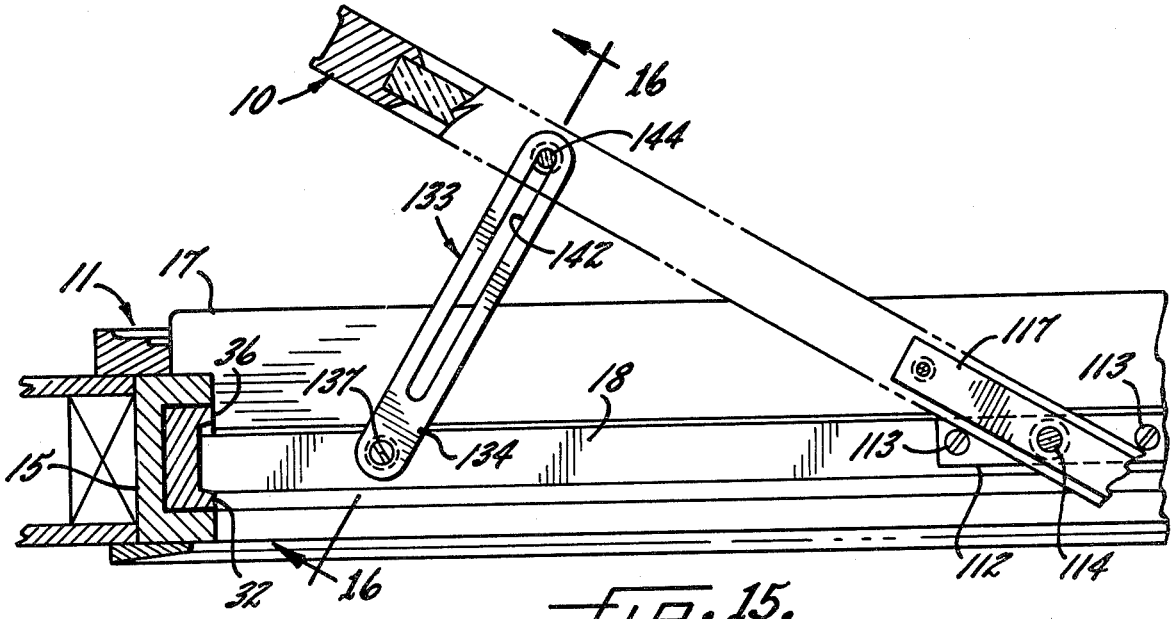
FIG. 15 is a fragmentary sectional view similar to FIG. 14 but showing the parts in a moved position.
Figure 16:
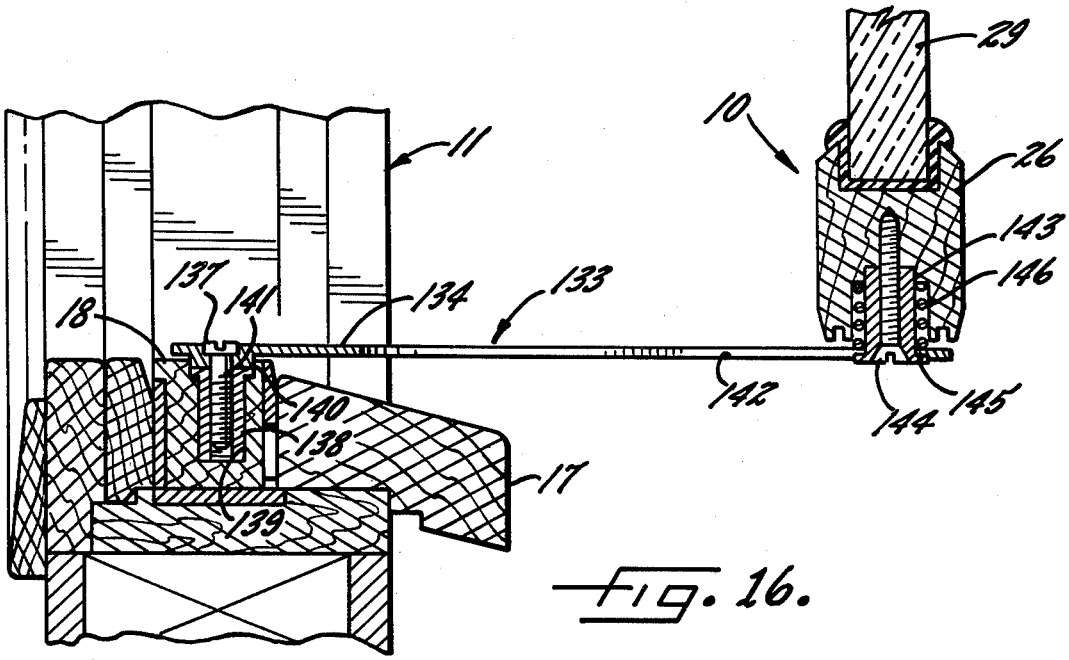
FIG. 16 is a fragmentary sectional view taken along the line 16—16 in FIG. 15.

Herein, the latching mechanism is connected to the sash 10 and is selectively connected to the frame 11 in a novel manner so that the sash may be set at either ventilating angle regardless of which side of the pane 29 is facing outwardly. As shown in FIGS. 14, 15 and 16, the latching mechanism 133 includes an expandable linkage with a link 134 having one end pivotally connected to the lower sash rail 26 near one end thereof and the other end selectively connected to pivot points 135 or 136 (FIG. 4), the points being on the mounting bar 18 with the point 135 being spaced inwardly a preselected distance from the left end of the mounting bar and the pivot point 136 being spaced inwardly the same distance from the right end of the mounting bar. FIGS. 2, 14, 15 and 16 illustrate the link 134 connected at the point 135 on the left side. The pivot includes a screw 137 threaded in a bushing 138 which is pressed into a hole 139 (FIG. 16) in the mounting bar and the inner end of the link 134 has a boss 140 which encircles the upper shank 141 of the screw so that the inner end of the link pivots about the screw 137. Formed in the link 134 is an elongated slot 142 and a vertical sleeve 143 projects through the slot 142 and is fastened to the underside of the lower rail 26 of the sash 10 by a screw 144 (FIG. 16). A head 145 is formed on the lower end of the sleeve 143 and this head is spaced from the lower side of the sash rail 26 by a distance slightly greater than twice the thickness of the link 134. The outer end of the slot 142 encircles the sleeve 143 and, by a compression spring 146 acting between the rail 26 and the link 134, an end of the slot 142 is latched to the head 145 of the sleeve. Such latching holds the sash in the ventilating position. To release this latching action, the outer end of the link 134 is pressed up manually so that the sleeve 143 may slide in the slot 142 and the sash 10 may be swung to the closed position. To switch the latching mechanism to the point 136, the screw 137 is unthreaded from the bushing 138, the sash 10 is swung around and the screw is threaded into a similar bushing 138′ (FIG. 13) at the point 136. When the screw is not threaded into either bushing, the sash is free to turn 360 degrees in the frame 11.

Figure 17:
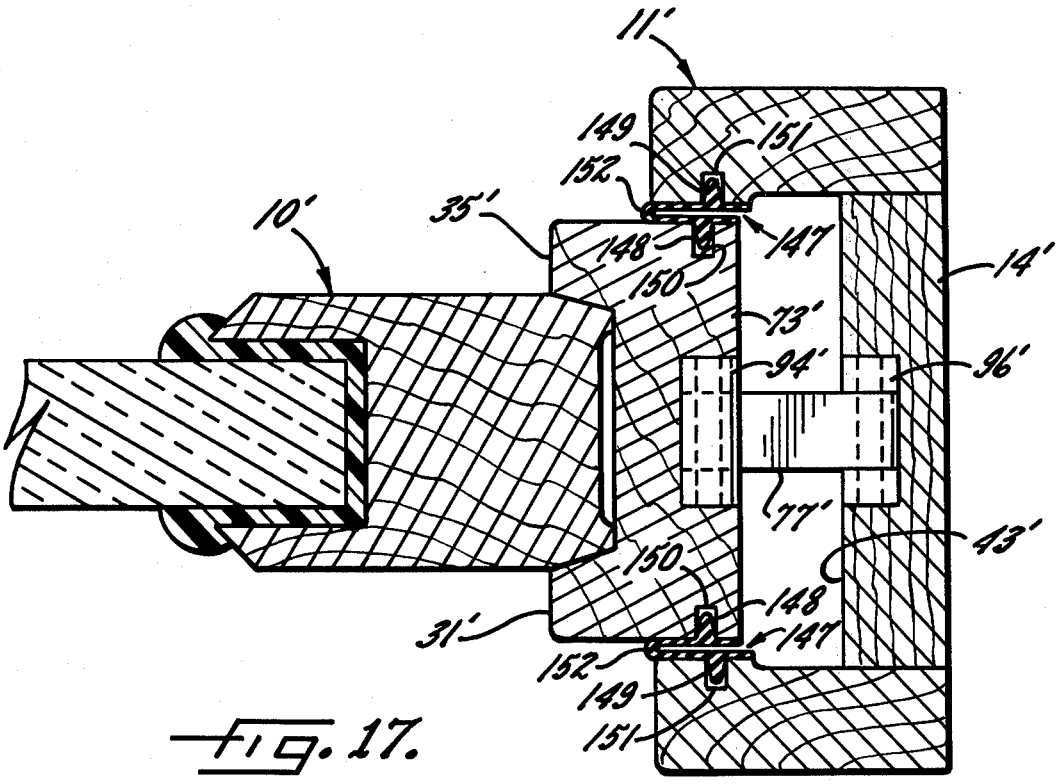
FIG. 17 is an enlarged fragmentary sectional view generally similar to FIG. 10 and showing a modified form of the invention.

As shown in the modification in FIG. 17 in which corresponding parts are indicated by the same but primed reference characters, novel seals 147 may be disposed between the draft stops and the frame 11. The seals are flexible and include an elongated folded portion which permits the draft stops to move between their active and retracted positions while maintaining the sealing action between the stops and the frame. In the form illustrated, a seal 147 is disposed on each side of the block 73′ which forms the draft stops 31′ and 35′ and the side jamb 14′ on the inside of the recess 43′. The seals are made of a resilient material such as rubber and extend substantially the full length of the block 73′. Each seal has enlarged stubs 148 and 149 snugly fitting in notches 150 and 151 formed respectively in the adjacent side of the block 73′ and the side jamb 14′. Integral with the stubs and connecting the latter is a narrow elongated sheet 152 folded longitudinally upon itself. As the block 73′ and draft stops 31′ and 35′ move in and out, the parts of the fold shift relative to each other thus keeping the space between the block and the side jamb sealed.

I claim:

1. A window comprising a horizontal sill, an elongated horizontal head jamb disposed above said sill, two vertical side jambs with each connecting one end of said sill with the adjacent end of said head jamb whereby said sill and said jambs constitute the rectangular frame of the window, a rectangular sash including top and bottom rails and side stiles and received in said frame, means for supporting said sash to turn about a centerline of the sash, first and second elongated recesses with one formed in each of said side jambs and opening horizontally toward each other, a third elongated recess formed in said head jamb along substantially the entire length thereof and opening downwardly, first, second and third elongated channel members disposed respectively in said first, second and third recesses, said first and second channel members being substantially as long as said stiles and said third channel member being substantially as long as said head rail, each of said channel members having two elongated legs projecting inwardly and extending parallel to each other substantially throughout the length of the associated channel member, the stile opposing said first channel member having inner and outer abutment surfaces formed on the sides thereof and extending the length of the stile, opposing and mating surfaces formed on the legs of said first channel member and normally engaging the surfaces on the stile to form a seal between the stile and said frame, similar surfaces formed on the other of said stiles and on the legs of said second channel member and similar surfaces also being formed on said head rail and the legs of said third channel member, mechanism operable to retract said channel members into their respective recesses thereby to permit said sash to swing about said centerline, a fourth recess formed in said sill along substantially the full length thereof and opening upwardly, an elongated draft stop disposed in said fourth recess, said bottom rail having an abutment surface formed on the inner side thereof and extending the length of the bottom rail, an opposing and mating abutment surface formed on said draft stop and normally engaging the surface on said bottom rail, a generally flat and elongated seal bar disposed in said fourth recess outwardly of said draft stop and extending substantially throughout the length thereof, said seal bar being disposed in a vertical plane with its upper edge portion facing the underside of said bottom rail, an elongated groove formed in and extending lengthwise of the underside of said bottom rail and normally receiving said upper edge portion of said seal bar, and means connected to said mechanism and operable to retract said draft stop and said seal bar into said fourth recess as said channel members are retracted into their respective recesses.

* * * * *